US005660054A

United States Patent [19]

Rice

[11] Patent Number: 5,660,054

[45] Date of Patent: Aug. 26, 1997

[54] CONDENSING UNIT ENCLOSURE

[75] Inventor: Steven Lee Rice, Dayton, Ohio

[73] Assignee: Copeland Corporation, Sidney, Ohio

[21] Appl. No.: 547,452

[22] Filed: Oct. 24, 1995

[51] Int. Cl.[6] ..... F25D 23/12; A47B 77/08; A47F 3/04

[52] U.S. Cl. ..... 62/259.1; 312/236

[58] Field of Search ..... 62/259.1, 507; 165/DIG. 204; 52/79.1; 312/236, 223.1

[56] References Cited

U.S. PATENT DOCUMENTS

| | | | |
|---|---|---|---|
| D. 244,293 | 5/1977 | Carluccio | D23/139 |
| 4,153,310 | 5/1979 | Loving et al. | 312/100 |
| 4,398,653 | 8/1983 | Daloisio | 222/185 |
| 4,858,683 | 8/1989 | Beehler | 165/125 |
| 4,953,328 | 9/1990 | Sewell et al. | 52/79.1 |
| 5,158,486 | 10/1992 | Tamame | 62/506 |
| 5,294,195 | 3/1994 | Amr et al. | 312/236 |
| 5,303,438 | 4/1994 | Walker | 5/652 |

*Primary Examiner*—William Doerrler

*Attorney, Agent, or Firm*—Harness, Dickey & Pierce, P.L.C.

[57] ABSTRACT

A cover for an outside air conditioning system includes a hood molded from a single piece of plastic and a metal grill secured to the cover and the air conditioning system. The molding of the cover allows for the addition of colored dyes to be added to the virgin material during the molding process for producing covers of various colors. The design of the cover permits nesting of the covers during shipment in order to reduce the costs associated with transporting the covers.

14 Claims, 3 Drawing Sheets

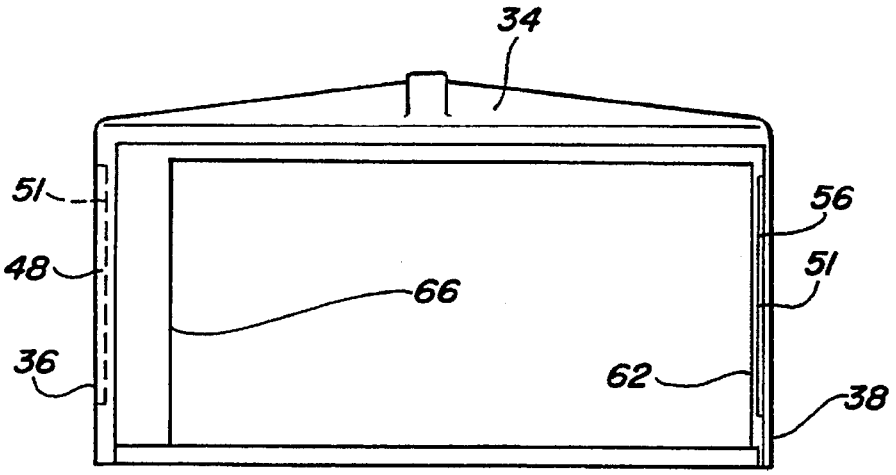
Fig - 5
Fig - 6
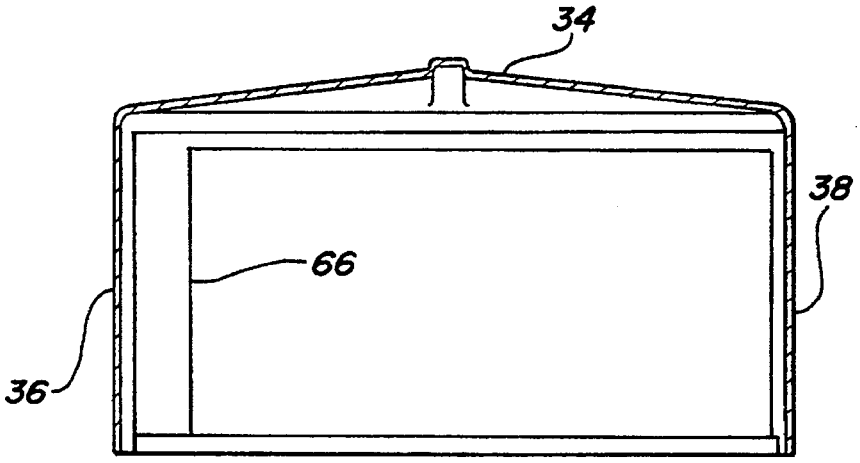

CONDENSING UNIT ENCLOSURE

FIELD OF THE INVENTION

The present invention relates to air conditioning system covers. More particularly, the present invention relates to a plastic cover for protecting an externally mounted air conditioner compressor/condenser unit from the environment.

BACKGROUND OF THE INVENTION

Central air conditioning and/or heat pump systems are common in a large number of residences and commercial buildings. The central air conditioning and/or heat pump systems include a compressor/condensing unit which is usually located outside the building. A typical refrigerant based air conditioning or heat pump system includes an exteriorly located compressor/condensing unit along with its associated coils, electrical components and a fan. These systems are usually contained in a box-like sheet metal enclosure or cabinet which is mounted on a concrete slab. The fan forces a flow of air through the enclosure to promote heat transfer between the air and the refrigerant. These exteriorly located units are exposed to rain, snow, debris as well as direct sunshine. The box-like sheet metal structure is typically painted in a green or beige color which is not aesthetically appealing to some individuals. In most residential applications, these exterior units are located in a side or rear area of the home and hid by some type of plantings due to the non-aesthetically appealing look of the units.

Accordingly, what is needed is a low cost, light weight cover for an exteriorly located compressor/condenser unit which overcomes the problems and disadvantages of the prior art box-like enclosures. In addition, the cover should be capable of being shipped from the cover manufacturer to the air conditioning system manufacturer or to the end user in such a manner that these covers nest with one another in order to avoid the problems of packaging space during shipment.

SUMMARY OF THE INVENTION

The present invention provides the art with a cover for a compressor/condenser unit which is made from plastic by a rotational molding process. The cover includes a top and two sides as well as a detachable wire grill on one end. The rotational molding process puts additional material in the corners of the cover for increased strength as well as allowing colored dyes to be added to the virgin powder material to enable the manufacturer to match the color of the cover with the color scheme of the structure or building to which the unit is being attached. The design of the cover will allow the covers to nest during shipment and storage, drastically reducing the space taken up, and significantly reducing the costs of storing and shipping the covers.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention:

FIG. 5 is a view of the opposite side of the cover shown in FIGS. 1 and 2; and FIG. 6 is a sectional view of the cover taken in the direction 6—6 shown in FIG. 2.

DESCRIPTION OF THE PREFERRED EMBODIMENT

Figure 1:
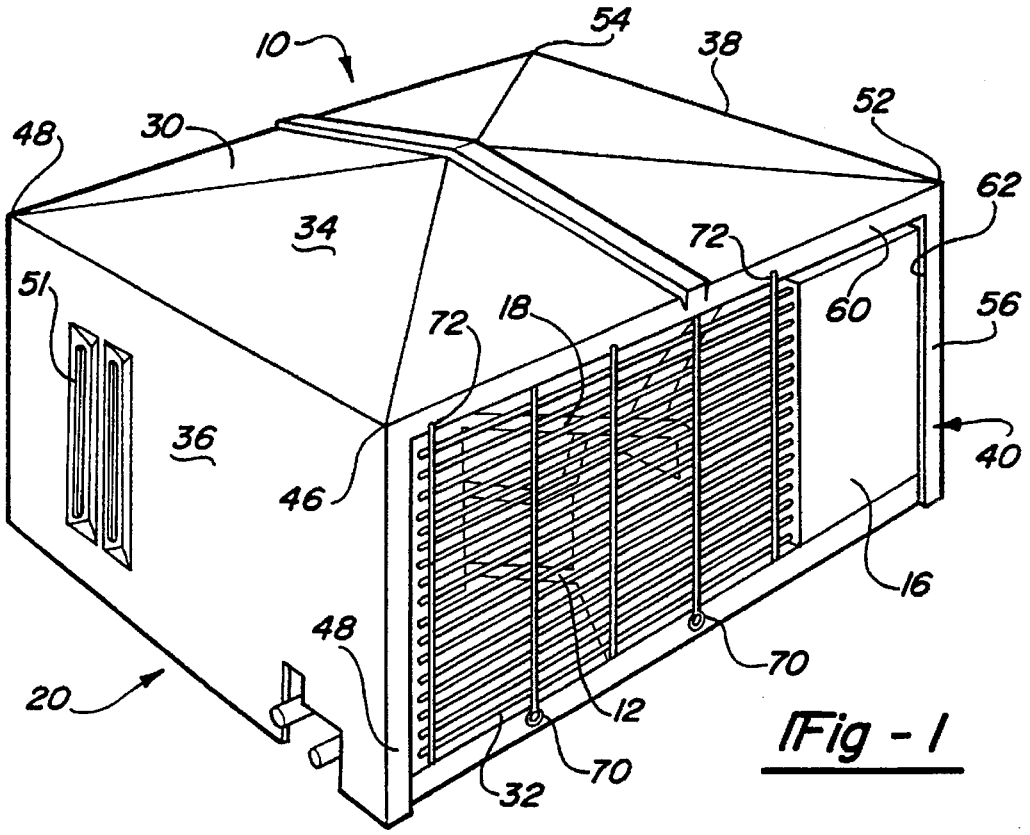
FIG. 1 is a perspective view of a compressor/condensing unit of the present invention.
Figure 2:
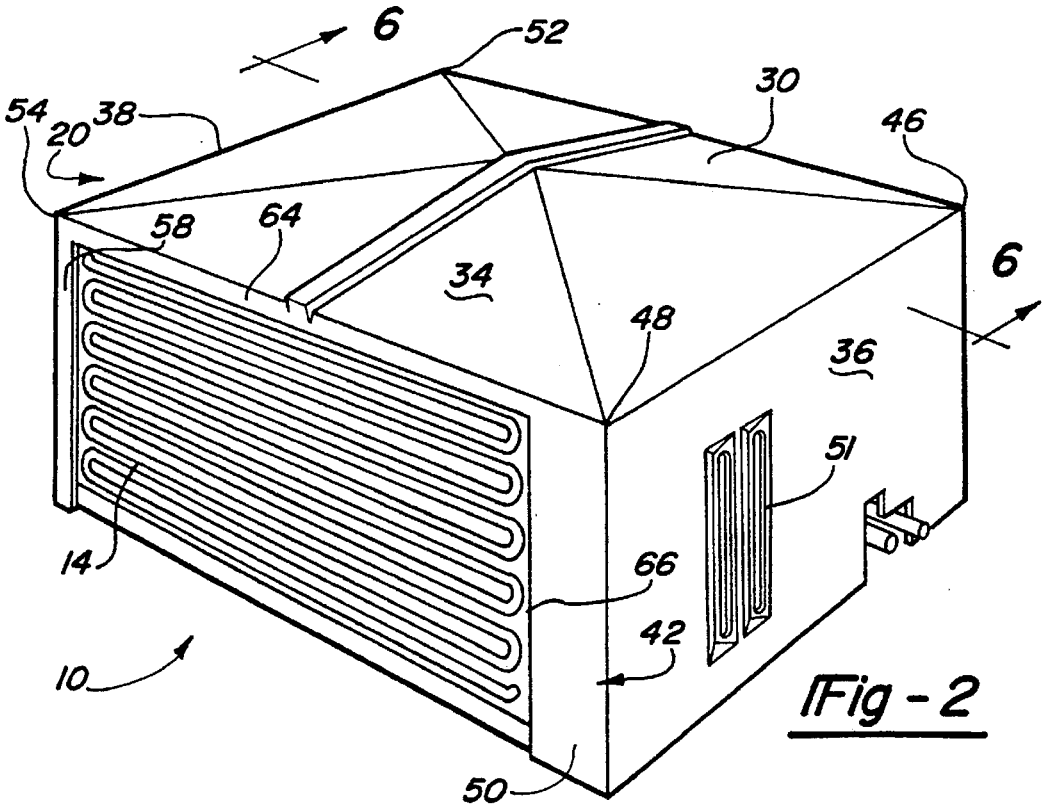
FIG. 2 is a perspective view of the compressor/condensing unit of the present invention taken in the opposite direction of that shown in FIG. 1.

Referring now to the drawings in which like reference numerals designate like or corresponding parts throughout the several views, there is shown in FIGS. 1 and 2 a compressor/condensing unit according to the present invention which is designated generally by the reference numeral 10. Compressor/condensing unit 10 comprises a compressor system 12, condensor coils 14, an electrical control box cover 16, a fan assembly 18 and a cover assembly 20. Compressor system 12, condensor coils 14, electrical control box cover 16 and fan 18 are all located within cover assembly 20 in order to protect these components from the environment. Compressor system 12, control box cover 16 and fan 18 are all well known in the art and will therefore not be discussed further herein.

Cover assembly 20 comprises a plastic hood 30 and a detachable wire grill 32. Hood 30 is a one piece plastic hood that is produced using a rotational molding process. Hood 30 comprises a top wall 34, two side walls 36 and 38, and two end walls 40 and 42. Top wall 34 is a generally rectangular wall which is angled downwardly in four directions beginning generally at the center of the wall. This four direction angling or pyramiding facilitates the runoff of rain and snow to avoid the possibilities of puddling of water as well as limiting the accumulation of debris on the top of hood 30.

Side wall 36 extends generally vertically from one edge of top wall 34. The vertical edges of side wall 36 extend over the two corners 44 and 46 of top wall 34 to produce a pair of flanges 48 and 50 which form a portion of end walls 40 and 42 as well as provide stability and strength to hood 30. Side wall 36 includes a pair of louvers 51 which allow for the flow of air through a portion of side wall 36.

Side wall 38 extends generally vertically from the edge of top wall 34 opposite to side wall 36. The vertical edges of side wall 38 extend over the corners 52 and 54 of top wall 34 to provide a pair of flanges 56 and 58 which form an additional portion of end walls 40 and 42 as well as provide stability and strength to hood 30. Side wall 38 also includes a pair of louvers to allow for the flow of air through a portion of side wall 38.

End wall 40 is comprised of flange 48, flange 56 and flange 60 extending generally vertically from one end of top wall 34 which extends between side walls 36 and 38. Flanges 48, 56 and 60 cooperate to form an aperture 62 which extends through end wall 40 to provide for the mating with electrical box cover 16 and for the attachment of wire grill 32 as will be described later herein.

End wall 42 is comprised of flange 50, flange 58 and a flange 64 extending generally vertically from the edge of top wall 34 opposite to end wall 40. Flanges 50, 58 and 64 cooperate to form an aperture 66 which extends through end wall 42 to provide for the flow of air through condensor coils 14 as will be describe later herein.

Hood 30 is preferably manufactured from HDPE using a rotational molding process. The rotational molding process, which is known well in the art, lends itself extremely well with the present invention. The molding process will put an increasing material thickness in the corners of hood 30 to provide structural stability to hood 30. This is illustrated in FIG. 6 which specifically shows the thickening of the material in each corner. In addition to adding more material to improve the strength of hood 30, the color of hood 30 can be selected simply by adding a dye or multiple dyes to the virgin powder material being used to manufacture hood 30. This allows the manufacturer to tailor the color of hood 30 to the color scheme of the structure that it is being attached to. Once in place, hood 30 will not rust and the color will not significantly deteriorate providing a long lasting cover which is more aesthetically pleasing to the consumer. In addition, if the color scheme of the building is changed, the low manufacturing costs of hood 30 allows the consumer to simply replace hood 30 with one that matches the new color scheme of the building.

Figure 3:
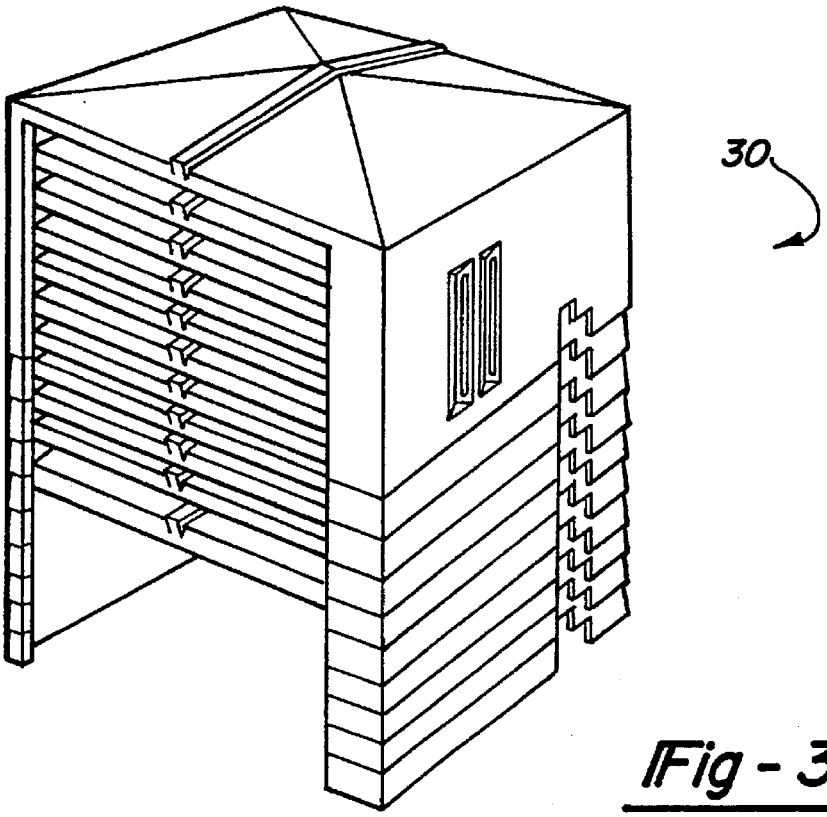
FIG. 3 is a perspective view of a plurality of nested covers for the compressor/condensing unit shown in FIG. 1.
Figure 4:
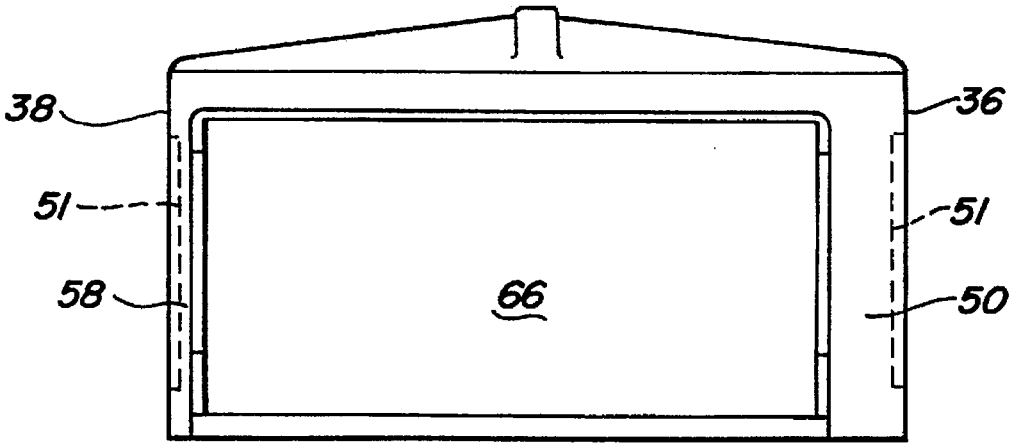
FIG. 4 is a view of one side of the cover shown in FIGS. 1 and 2.

Hood 30 can be manufactured by the same manufacturer of the compressor/condensing unit or it can be manufactured by a separate plastic molding company. Hoods 30 are transported to the compressor/condensing unit manufacturer or to a commercial parts supply house in a nested condition as shown in FIG. 3. The design of hood 30 in conjunction with the flexibility of the plastic material allows for the nesting of hoods 30 without fear of damaging, marring or distorting the hoods.

Once an individual hood 30 of the appropriate color has been delivered to the building site and compressor/condensing unit 10 has been installed, hood 30 is fitted over compressor/condensing unit 10 and secured to the base of unit 10 by a plurality of stainless steel or plated screws (not shown). When hood 30 is fitted over unit 10, aperture 66 fits around condensor coils 14 allowing the flow of air to be effectively driven through condensor coils 14, thus effecting enhanced heat exchange between the forced air and condensor coils 14. After securing hood 30 to unit 10, wire grill 32 is attached to hood 30 to cover aperture 62 by first hooking grill 32 through a plurality of holes 72 in flange 60 and securing the lower end of grill 32 to the base of unit 10 using a plurality of stainless steel or plated screws 70.

Wire grill 32 provides for the free flow of cooling air driven by fan 18 through cover assembly 20 to provide for the efficient heat transfer between the air and condensor coils 14 of compressor/condensing unit 10.

While the above detailed description describes the preferred embodiment of the present invention, it should be understood that the present invention is susceptible to modification, variation and alteration without deviating from the scope and fair meaning of the subjoined claims.

What is claimed is:

1. A condensing unit comprising:

a heat exchanger;

a fan for directing air flow to said heat exchanger; and a single piece molded cover enclosing said heat exchanger and said fan, said cover comprising:

a solid top wall covering said entire condensing unit;

a pair of side walls extending generally perpendicular from first opposite sides of said top wall;

a pair of end walls extending generally perpendicular from second opposite sides of said top wall between said side walls, said end walls each defining an aperture for allowing said air flow through said cover.

2. The condensing unit of claim 1 herein said cover is manufactured from plastic.

3. The condensing unit of claim 1 further comprising an electrical panel disposed within one of said apertures.

4. The condensing unit of claim 1 wherein said cover further comprises a wire grill covering one of said apertures.

5. The condensing unit of claim 1 wherein said cover is molded from plastic.

6. A single piece molded cover for a condensing unit, said cover comprising:

a solid top wall covering said entire condensing unit;

a pair of side walls extending generally perpendicular from said first opposite sides of said top wall;

a pair of end walls extending generally perpendicular from second opposite sides of said top wall between said side walls, said end walls each defining an aperture for allowing air flow through said cover.

7. The cover of claim 6 wherein said cover is manufactured from plastic.

8. The cover of claim 6 wherein said cover further comprises a wire grill covering one of said apertures.

9. The cover of claim 1 wherein said cover is molded from plastic.

10. The cover of claim 6 wherein each of said sidewalls and each of said end walls have a first thickness of material a corner is formed at the meeting of each of said side wails and each of said end walls and at the meeting of said top wall and each of said side walls and each of said end walls, said corners having a second thickness of material, said second thickness being greater than said first thickness.

11. The cover of claim 10 wherein said cover is manufactured as a single piece structure.

12. The cover of claim 11 wherein said cover is molded from plastic.

13. A method of manufacturing a single piece cover having a solid top wall and a specified color for an air conditioning system, said method comprising the steps of:

providing a specified quantity of material to a mold;

providing a specified quantity of said specified color of dye to said mold; and molding said material and said specified color of dye to form said cover having said specified color.

14. The method of manufacturing according to claim 13 wherein said step of molding includes rotational molding.

* * * * *

UNITED STATES PATENT AND TRADEMARK OFFICE

CERTIFICATE OF CORRECTION

PATENT NO. : 5,660,054
DATED : August 26, 1997
INVENTOR(S) : Steven Lee Rice

It is certified that error appears in the above-indentified patent and that said Letters Patent is hereby corrected as shown below:

Column 2, line 63, "describe" should be -- described --.

Column 4, line 9, "herein" should be -- wherein --.

Column 4, line 34, after "material" insert -- and --.

Column 4, line 35, "wails" should be -- walls --.

Signed and Sealed this

Twenty-sixth Day of May, 1998

*Attest:*

*Attesting Officer*

Bruce Lehman

BRUCE LEHMAN

*Commissioner of Patents and Trademarks*